United States Patent [19]

Volontá et al.

[11] Patent Number: 4,873,763

[45] Date of Patent: Oct. 17, 1989

[54] METHOD FOR OBTAINING ELECTRICAL EARTH CONNECTION DEVICE, PARTICULARLY FOR VEHICLES

[75] Inventors: Piero Volontá; Matteo Picciriello, both of Turin, both of Italy

[73] Assignee: Fiat Auto S.p.A., Turin, Italy

[21] Appl. No.: 266,347

[22] Filed: Nov. 1, 1988

Related U.S. Application Data

[63] Continuation of Ser. No. 97,458, Sep. 15, 1987, abandoned.

[30] Foreign Application Priority Data

Sep. 16, 1988 [IT] Italy ..... 53831/86[U]

[51] Int. Cl.[4] ..... H01R 43/00

[52] U.S. Cl. ..... 29/825; 411/171; 411/177; 439/92

[58] Field of Search ..... 29/825, 852, 860, 863; 174/68.5; 439/92; 411/171, 177, 181, 183

[56] References Cited

U.S. PATENT DOCUMENTS

| | | | |
|---|---|---|---|
| 3,880,486 | 4/1975 | Avakian | 174/68.5 X |
| 4,034,471 | 7/1977 | Bias | 29/863 X |
| 4,471,160 | 9/1984 | Arther | 29/860 X |

FOREIGN PATENT DOCUMENTS

| | | | |
|---|---|---|---|
| 2156771 | 6/1973 | France | 29/860 |

OTHER PUBLICATIONS

Western Electric Technical Digest, No. 20, Oct., 1970, pp. 33–34, by J. M. Glasson et al.

*Primary Examiner*—Howard N. Goldberg
*Assistant Examiner*—Carl J. Arbes
*Attorney, Agent, or Firm*—Frost & Jacobs

[57] ABSTRACT

A method for obtaining an electrical earth connection device wherein a metal plate having a threaded seat is provided with a screw having a flanged head which is tightened against the plate, whereupon the assembly so formed is affixed to a vehicle body and the vehicle body together with the connection device is painted in a painting bath, whereupon the screw is loosened to receive a cable terminal.

4 Claims, 2 Drawing Sheets

METHOD FOR OBTAINING ELECTRICAL EARTH CONNECTION DEVICE, PARTICULARLY FOR VEHICLES

This is a continuation of application Ser. No. 07/097,458, filed 9/15/87, now abandoned.

BACKGROUND OF THE INVENTION

This invention relates to a method for obtaining an electrical earth connection device particularly for vehicles, ie a device for electrically connecting one of the poles of the vehicle electrical system to the vehicle body by means of a cable terminal.

An incorrect earth connection is known to create operational difficulties in the electrical and electronic equipment with which the vehicle is provided. Because of the malfunction of such equipment caused by the incorrect earth connection, the repairer is sometimes inclined to replace the equipment, although perfectly operational.

To form a correct electrical earth connection, one of the cable terminals of the vehicle electrical system is fixed to the vehicle body by clampimg it between two conducting surfaces using earth connection devices.

Known devices comprise a screw carrying the terminal and screwed into a hole provided in the veicle body and/or into a threaded seat in the form of a nut projection-welded to the body, or a stud fixed to the body and on which the terminal is mounted and then locked by means of a nut.

During the painting of the vehicle body, these devices are unfortunately reached by the paint in spite of the application of protective masking, with resultant reduction in the conductivity of the surfaces against which the terminal is intended to make contact.

SUMMARY OF THE INVENTION

The object of the present invention is to provide a method for obtaining an electrical earth connection device particularly for vehicles, whichi s free of the aforesaid drawbacks.

The present invention provides a method for obtaining an electrical earth connection device for vehicles, characterised by comprising a metal plate fixed to a portion of the body of said vehicle and in which a threaded seat is provided, and a screw comprising a threaded shank screwed into said seat and a head provided with a flange; between this latter and said plate there being clampable a cable terminal of the electrical system of said vehicle.

BRIEF DESCRIPTION OF THE DRAWINGS

The present invention will be more apparent from the description of a preferred embodiment thereof given hereinafter by way of non-limiting example with reference to the accompanying drawings, in which.

DETAILED DESCRIPTION OF THE INVENTION

Figure 1:
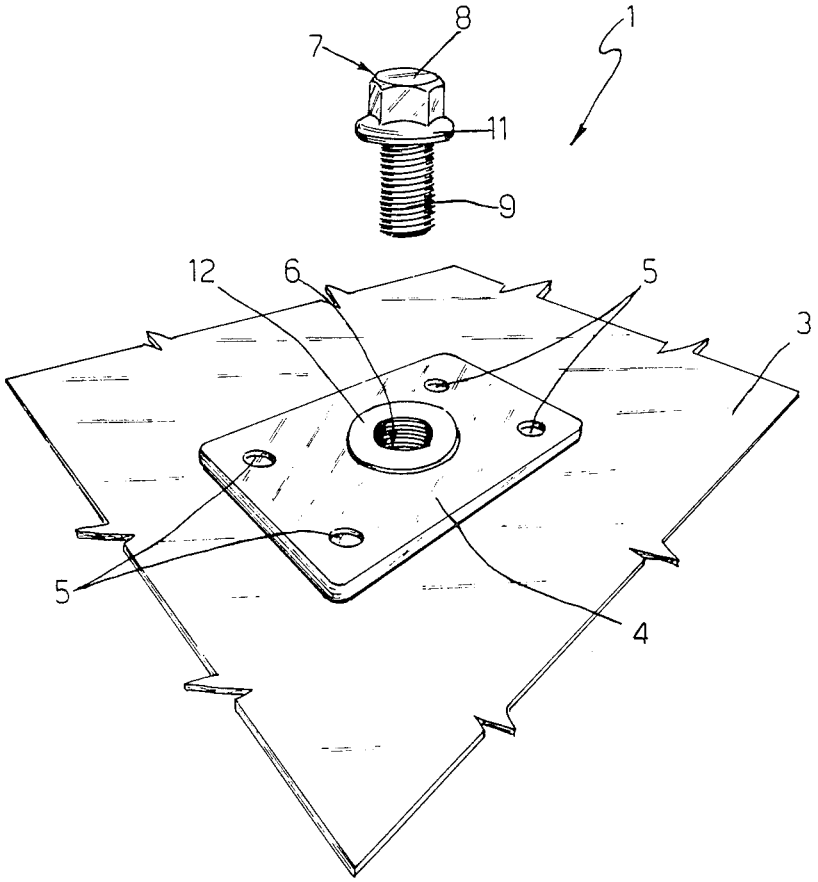
FIG. 1 is a perspective exploded view of an electrical earth connection device for a vehicle.
Figure 2:
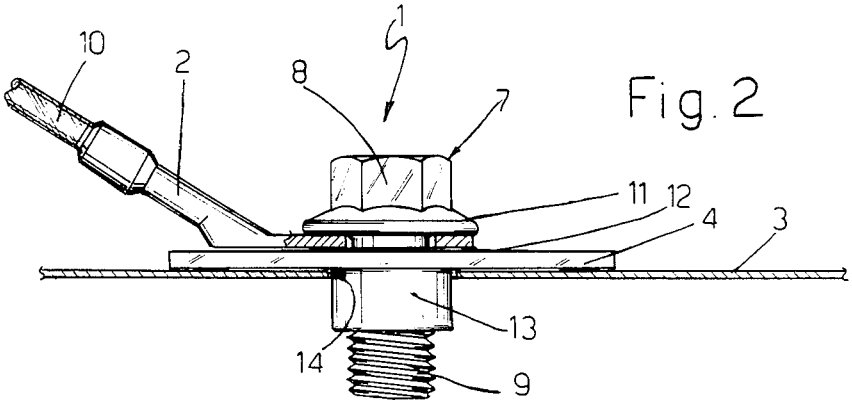
FIGS. 2 and 3 are sectional and plan views respectively of the device of FIG. 1 for connecting an electric cable terminal to earth.
Figure 3:
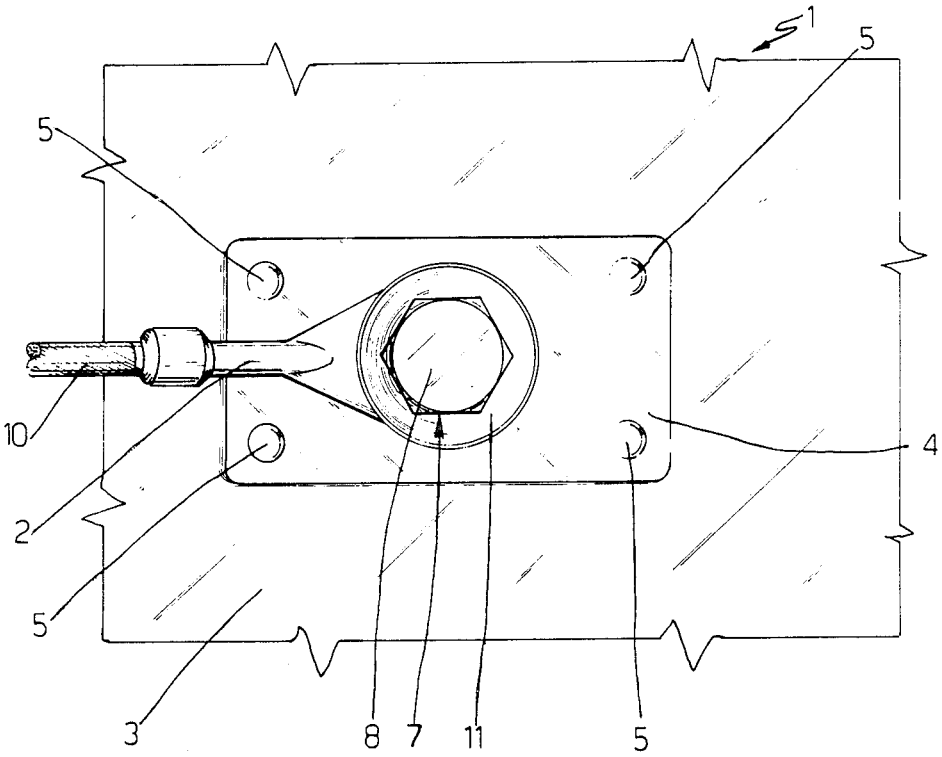

As shown on the accompanying drawings, the reference numeral 1 indicates overall an electrical earth connection device for a vehicle able to cooperate with a terminal 2 carried by a wiring cable 10 of the electrical system or of an individual item of electrical or electronic equipment installed in the vehicle. The electrical earth to which all the equipment cables are connected is in this case the vehicle body, of which a portion 3 is shown. The device 1 comprises a plate 4 fixed to the portion 3 preferably by projection or spot welding formed in known manner by a series of spots 5, which in the case shown are four in number and are formed by plastic deformation of the plate 4. In this latter, a threaded seat 6 is provided (FIG. 1) for a screw 7 having a hexagonal head 8 and a threaded shank 9. According to the invention, the head 8 is provided peripherally with a flange 11, which forms one of the contact surfaces for the terminal 2. A collar 12 is provided upperly on the plate 4 in correspondence with the seat 6, and projects perpendicularly from the surface of the plate 4 so that its front surface forms the second contact surface for the terminal 2 which, in this case, surrounds the seat 6. When in use, the terminal 2 is clamped between the flange 11 and collar 12 (FIGS. 2 and 3). In the non-limiting illustrated example, there extends from the lower surface of the plate 4 a boss 13 (FIG. 2) which is internally threaded to define the seat 6 and into which the shank 9 of the screw 7 is screwed when in use. The boss 13 extends beyond the body portion 3 through a through hole 14 provided in this latter. The collar 12 and boss 13 are formed preferably integrally with the plate 4, which is preferably constructed of stainless steel or of iron provided with a protective coating formed for example by galvanizing or tinning.

When in use, the plate 4-screw 7 assembly is firstly constructed, taking care to fully tighten the screw 7 with a predetermined torque wrench setting such that the lower surface of the flange abuts with perfect adherence against the upper front surface of the collar 12, which is raised above the rest of the upper surface of the plate 4. This assembly is fixed to the vehicle body by projection-welding the plate 4 onto it. The vehicle body together with the said assembly is then immersed in the painting baths. However, the paint does not coat the said contact surfaces of threads of the shank 9 and seat 6 as these are isolated in a fluid-tight manner by the formation of the plate 4-screw 7 assembly. After painting, the screw is unscrewed on the assembly line, and after mounting the terminal 2 over its shank 9 it is again screwed down completely, to thus form the required earth contact.

Thus with the device 1, the said contact surfaces and threads are free of paint traces or infiltration and at the same time are free of oxidation. The provision of the collar 12 means that a flat surface perpendicular to the thread of the seat 6 is available for the precise purpose of supporting the terminal 2. Furthermore, the provision of the collar 12 prevents the paint lying at a level, after unscrewing the screw 7, which is above the contact surface for the terminal 2, so preventing effective fixing of this latter.

The thickness of the collar 12 must obviously be greater than the paint thickness.

Finally, modifications can be made to the device 1 described and illustrated herein, but without leaving the scope of protection of the present invention.

We claim:

1. A method for obtaining an electrical earth connection device for vehicles, comprising the steps of:

(a) providing a metal plate for having a threaded seat (6), and a screw (7) having a threaded shank (9) and a head (8) provided with an annular flange (11);

(b) tightening the screw (7) with a predetermined torque wrench setting in order to abut with perfect adherence the lower surface of the flange (11) against the upper surface of the plant (4) in the area surrounding said seat (6);

(c) affixing the assembly so formed to a portion (3) of a vehicle body and then painting the vehicle body and the assembly so formed by immersion in a painting bath; and (d) at least partially unscrewing the screw (7) from the seat (6) after painting and mounting a cable terminal (2) on the shank (9), and thereafter tightening the screw (7) into the seat (6) until the cable terminal (2) is clamped between the plate (4) and the flange (11).

2. The method claimed in claim 1 including the step of providing a collar (12) in the plate (4) surrounding the seat (6) and projecting upwardly from the upper surface of the plate (4) to form a support surface for the terminal (2), including the step of abutting the flange (11) of the screw (7) against the upper surface of the collar (12) during tightening of the screw (7) before the painting step.

3. The method claimed in claim 2 including the step of providing an internally threaded boss (13) on the plate (4) extending outwardly from the surface of the plate (4) opposite the collar (12) and in axial alignment with the collar (12), the collar (12) defining the seat (6) into which the shank (9) of screw (7) is threaded.

4. The method claimed in claim 1 including the step of affixing the assembly of the plate (4) and the screw (7) to the vehicle body by projection-welding the plate (4) to the vehicle body.

* * * * *